US012458073B2

(12) United States Patent
Huang et al.

(10) Patent No.: US 12,458,073 B2
(45) Date of Patent: Nov. 4, 2025

(54) VAPOR GENERATION DEVICE AND INFRARED EMITTER

(71) Applicant: SHENZHEN FIRST UNION TECHNOLOGY CO., LTD., Shenzhen (CN)

(72) Inventors: Linjian Huang, Shenzhen (CN); Jian Wu, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 376 days.

(21) Appl. No.: 18/014,160

(22) PCT Filed: Jul. 2, 2021

(86) PCT No.: PCT/CN2021/104334
§ 371 (c)(1),
(2) Date: Jan. 1, 2023

(87) PCT Pub. No.: WO2022/002267
PCT Pub. Date: Jan. 6, 2022

(65) Prior Publication Data

US 2023/0263237 A1 Aug. 24, 2023

(30) Foreign Application Priority Data

Jul. 3, 2020 (CN) ..... 202021283296.X

(51) Int. Cl.
*A24F 40/57* (2020.01)
*A24F 40/20* (2020.01)
(Continued)

(52) U.S. Cl.
CPC ..... *A24F 40/57* (2020.01); *A24F 40/20* (2020.01); *A24F 40/46* (2020.01); *A24F 40/51* (2020.01)

(58) Field of Classification Search
None
See application file for complete search history.

(56) References Cited

U.S. PATENT DOCUMENTS 11,272,578 B2 * 3/2022 Robert ..... H05B 3/44
2017/0079332 A1 * 3/2017 Li ..... A24F 40/46
(Continued)

FOREIGN PATENT DOCUMENTS

CN 105433441 A 3/2016
CN 109076650 A 12/2018
(Continued)

OTHER PUBLICATIONS

English Translation of CN_112841726 (CN_112841726 is already made of record) (Year: 2021).*
(Continued)

*Primary Examiner* — Manley L Cummins, IV
(74) *Attorney, Agent, or Firm* — Scully, Scott, Murphy & Presser, P.C.

(57) ABSTRACT

A vapor generation device and an infrared emitter is provided. The vapor generation device includes a housing, where the housing is internally provided with: a cavity, configured to receive an inhalable material; an infrared emitter, including an infrared emission material, where the infrared emission material is configured to heat the inhalable material by radiating an infrared ray; a temperature sensing material, formed on the infrared emitter and insulated from the infrared emission material, where the temperature sensing material has a positive or negative resistance-temperature coefficient; and a circuit, configured to obtain a resis-
(Continued)

tance value of the temperature sensing material and determine a temperature of the infrared emitter from the resistance value. The temperature of the infrared emitter can be determined by printing or depositing a temperature sensing material with a temperature sensor function on the infrared emitter itself and detecting the resistance of the temperature sensing material.

19 Claims, 5 Drawing Sheets

(51) Int. Cl.
*A24F 40/46* (2020.01)
*A24F 40/51* (2020.01)

(56) References Cited

U.S. PATENT DOCUMENTS

2017/0224018 A1* 8/2017 Li ..... A24F 40/46
2019/0166918 A1* 6/2019 Thorsen ..... A24F 40/50
2020/0046028 A1* 2/2020 Oh ..... H05B 3/46
2020/0253280 A1* 8/2020 Thorsen ..... A24F 40/46
2021/0100288 A1* 4/2021 Borges ..... A24F 40/51
2022/0240581 A1* 8/2022 Chen ..... A24F 40/46
2022/0322743 A1* 10/2022 Xie ..... H05B 3/04
2022/0338541 A1* 10/2022 Yu ..... H05B 3/46
2023/0051387 A1* 2/2023 Yu ..... A24F 40/46
2024/0206540 A1* 6/2024 Zhang ..... A24F 40/46

FOREIGN PATENT DOCUMENTS

CN 109077358 A * 12/2018 ..... A24F 47/008
CN 109561733 A 4/2019
CN 109792801 A 5/2019
CN 109846093 A 6/2019
CN 110384264 A 10/2019
CN 211910549 U 11/2020
CN 212279891 U 1/2021
CN 112841726 A 5/2021
TW 201944910 A 12/2019

OTHER PUBLICATIONS

English Translation of CN_109077358 (Year: 2018).*
English Translation of the Written Opinion of the International Search Authority of International Application No. PCT/CN2021/104334 (Year: 2021).*

* cited by examiner

VAPOR GENERATION DEVICE AND INFRARED EMITTER

CROSS-REFERENCE TO RELATED APPLICATIONS

This application is a 35 U.S.C. § 371 National Phase conversion of International (PCT) Patent Application No. PCT/CN2021/104334, filed on Jul. 2, 2021, which claims priority to Chinese Patent Application No. 202021283296.X, filed with the China National Intellectual Property Administration on Jul. 3, 2020 and entitled "VAPOR GENERATION DEVICE AND INFRARED EMITTER", which is incorporated herein by reference in its entirety. The PCT International Patent Application was filed and published in Chinese.

TECHNICAL FIELD

Embodiments of this application relate to the field of heat not burning e-cigarette device technologies, and in particular, to a vapor generation device and an infrared emitter.

BACKGROUND

Tobacco products (for example, cigarettes and cigars) burn tobacco during use to produce tobacco smoke. Attempts are made to replace these tobacco-burning products by manufacturing products that release compounds without combustion.

An example of such a product is a heating device that releases a compound by heating rather than burning a material. For example, the material may be tobacco or other non-tobacco products, where the non-tobacco products may or may not include nicotine. As an example of a known heating device, the tobacco product is heated by using an infrared emitter that can radiate an infrared ray to the tobacco product, and the temperature of the infrared emitter is measured by a temperature sensor during heating, so as to indirectly obtain a temperature of the heated tobacco product during heating, thereby controlling the heating process. As a known prior art, there is an error or change lag between a temperature result of the infrared emitter measured by the temperature sensor and a temperature at which the tobacco product is heated during an actual inhalation, which affects an accurate smoke emission control during the inhalation.

SUMMARY

In order to resolve a temperature monitoring error in the prior art, embodiments of this application provide a vapor generation device and an infrared emitter with more accurate temperature monitoring.

This application provides a vapor generation device, configured to heat an inhalable material to generate an aerosol for inhalation, including: a housing, where the housing is internally provided with:

a cavity, configured to receive an inhalable material;

an infrared emitter, including an infrared emission material, where the infrared emission material is configured to radiate an infrared ray to the inhalable material received in the cavity, so as to heat the inhalable material;

a temperature sensing material, formed on the infrared emitter and insulated from the infrared emission material, where the temperature sensing material has a positive or negative resistance-temperature coefficient; and a circuit, configured to obtain a resistance value of the temperature sensing material and determine a temperature of the infrared emitter from the resistance value.

In a preferred implementation, the temperature sensing material includes a conductive trajectory or a thermistor coating formed on the infrared emitter.

In a preferred implementation, the infrared emitter is configured to extend along an axial direction of the cavity and surround at least a part of the cavity.

In a preferred implementation, the infrared emitter further includes:

a base body, extending along the axial direction of the cavity and surrounding the cavity; and the infrared emission material is configured as a coating formed on the base body or a film wrapped or wound on the tubular base body.

In a preferred implementation, at least a part of a length of the temperature sensing material extending along the axial direction of the cavity covers a length of the infrared emission material extending along the axial direction of the cavity.

In a preferred implementation, the infrared emitter is configured in a shape of pin extending along an axial direction of the cavity, and is inserted into the inhalable material when the inhalable material is received in the cavity.

In a preferred implementation, the infrared emitter includes:

a base body, configured to be in a pin shape at least a part of which extends along the axial direction of the cavity, where the base body is provided with a hollow extending along the axial direction inside; and a substrate, accommodated in the hollow; and the infrared emission material is configured to be a coating formed on a surface of the substrate or a film wrapped on the substrate.

In a preferred implementation, the temperature sensing material is formed on a surface of the base body.

In a preferred implementation, the conductive trajectory is configured in a winding, bending, or spiral shape extending along a length direction of the infrared emitter.

In a preferred implementation, the infrared emitter includes:

an electrothermal layer, including a first side and a second side facing away from each other along a thickness direction;

the infrared emission material is positioned on the first side of the electrothermal layer and configured to radiate an infrared ray to the inhalable material received by the cavity when heated by the electrothermal layer; and the thermistor coating is positioned on the second side of the electrothermal layer.

In a preferred implementation, the infrared emitter further includes:

a first electrode layer, positioned on a first side of the electrothermal layer and electrically conductive with the electrothermal layer;

a second electrode layer, positioned between the electrothermal layer and the thermistor coating and electrically conductive with both the electrothermal layer and the thermistor coating; and a third electrode layer, positioned on a side of the thermistor coating away from the electrothermal layer and electrically conductive with the thermistor coating.

In a preferred implementation, the first electrode layer and the second electrode layer are staggered from each other along a thickness direction of the electrothermal layer.

This application further provides an infrared emitter for a vapor generation device, including:

an infrared emission material, configured to radiate an infrared ray to an inhalable material to heat the inhalable material; and a temperature sensing material, insulated from the infrared emission material and having a positive or negative resistance-temperature coefficient, so that a temperature of the infrared emitter is capable of being determined from a resistance value of the conductive trajectory or thermistor coating by measuring the resistance value.

According to the vapor generation device, the temperature of the infrared emitter can be determined by printing or depositing a temperature sensing material with a temperature sensor function on the infrared emitter itself and detecting the resistance of the temperature sensing material, which has a more stable combination property and causes a more accurate result compared with a case of using a temperature measurement manner of attaching thermocouples.

BRIEF DESCRIPTION OF THE DRAWINGS

One or more embodiments are exemplarily described with reference to the corresponding figures in the accompanying drawings, and the descriptions are not to be construed as limiting the embodiments. Components in the accompanying drawings that have same reference numerals are represented as similar components, and unless otherwise particularly stated, the figures in the accompanying drawings are not drawn to scale.

DETAILED DESCRIPTION

For ease of understanding of this application, this application is described below in more detail with reference to accompanying drawings and specific implementations.

An embodiment of this application provides a vapor generation device that heats but not burns an inhalable material, such as a cigarette, so as to volatilize or release at least one of inhalable materials to form an aerosol for inhalation.

Based on a preferred implementation, the heating on the inhalable material by the vapor generation device is performed by irradiating a far-infrared ray having a heating effect, for example, a far-infrared ray of 3 μm to 15 μm. During use, when the wavelength of the infrared ray matches the absorption wavelength of a volatile component of the inhalable material, the energy of the infrared ray is easily absorbed by the inhalable material, and the inhalable material is heated to volatilize at least one volatile component to generate an aerosol for inhalation.

Figure 1:
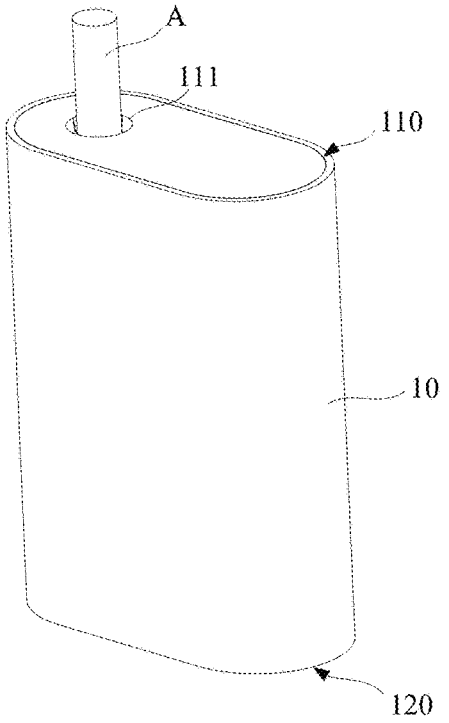
FIG. 1 is a schematic structural diagram of a vapor generation device according to an embodiment.
Figure 2:
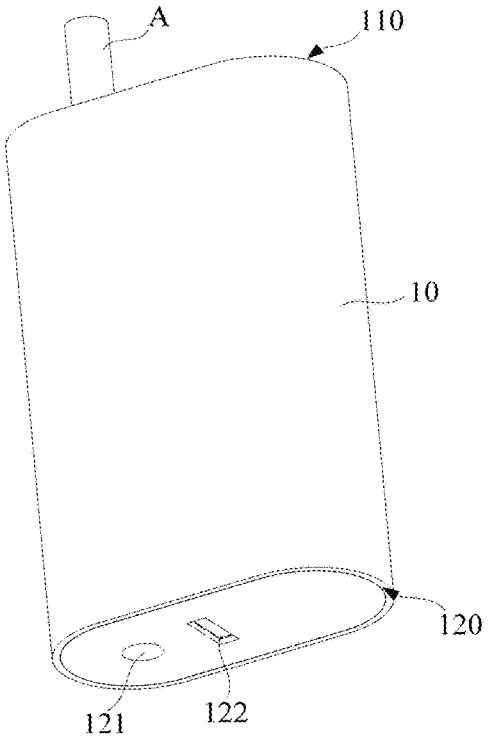
FIG. 2 is a schematic structural diagram of the vapor generation device in FIG. 1 from another viewing angle.

A configuration of the vapor generation device according to an embodiment of this application may be shown in FIG. 1 and FIG. 2. The overall shape of the device is generally configured into a flat cylinder shape, and an external member of the vapor generation device includes:

a housing 10, having a hollow structure inside, so as to form an assembling space for necessary functional components such as infrared radiation. The housing 10 has a near-end 110 and a far-end 120 opposite to each other along a length direction.

The near-end 110 is provided with a receiving hole 111, and an inhalable material A may be received in the housing 10 through the receiving hole 111 and heated or removed from the housing 10.

The far-end 120 is provided with an air inlet hole 121 and a charging interface 122. The air inlet hole 121 is configured to allow external air to enter the housing 10 during inhalation; and the charging interface 122, such as a USB type-C interface or a pin interface, is used for charging the vapor generation device after being connected to an external power source or an adapter.

Figure 3:
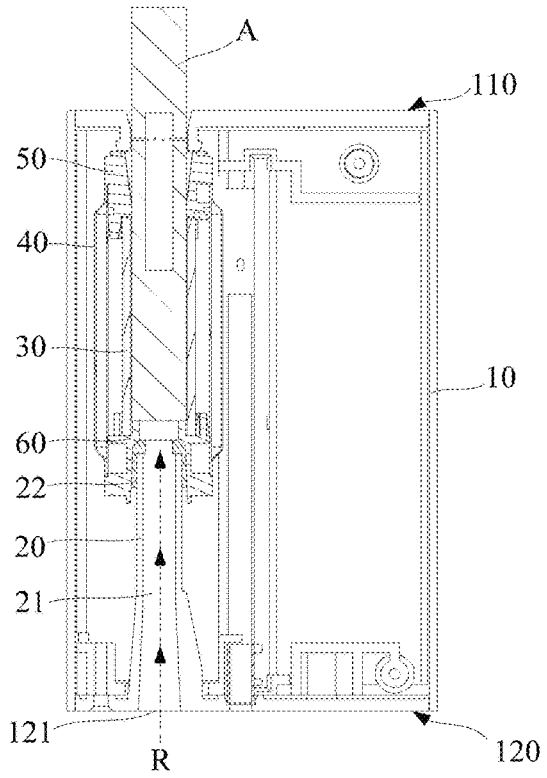
FIG. 3 is a schematic cross-sectional view of the vapor generation device in FIG. 1 along a width direction.
Figure 4:
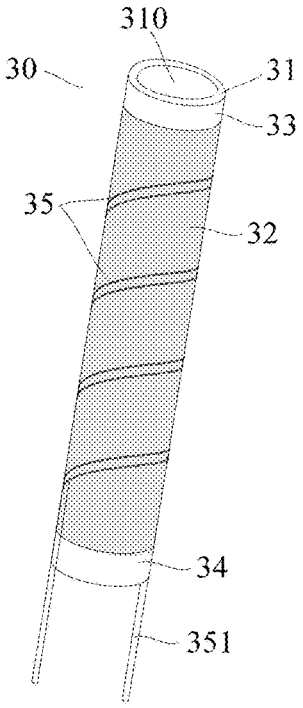
FIG. 4 is a schematic structural diagram of an embodiment of the infrared emitter in FIG. 3.

Further, the configuration of the interior of the housing 10 is shown in FIG. 3, an infrared emitter 30 is disposed along the length direction of the housing 10, and a three-dimensional configuration thereof may be shown in FIG. 4. The infrared emitter 30 includes:

a tubular base body 31, which is used as a rigid carrier and an object accommodating the inhalable material A. In the implementation, the tubular base body 31 may be made of a material that is high-temperature-resistant and can emit an infrared ray, such as quartz glass, ceramic, or mica. Preferably, the tubular base body 31 is made of a transparent material, such as a high-temperature-resistant material with an infrared transmittance of 95% or more. An inner space of the tubular base body 31 forms a cavity 310 for accommodating and heating the inhalable material A.

An infrared emission coating 32 formed on at least a part of an outer surface of the tubular base body 31, the infrared emission coating 32 is an electrically powered infrared emission coating, and may be capable of heating itself and radiating the infrared ray, such as the foregoing far-infrared ray of 3 μm to 15 μm, which can be used to heat the inhalable material A to the inhalable material received in the cavity 310 under the condition of being electrified. When a wavelength of the infrared ray matches an absorption wavelength of a volatile component of the inhalable material A, an energy of the infrared ray is easily absorbed by the inhalable material A.

Typically, in an implementation, the infrared emission coating 32 may be a coating prepared by ceramic materials such as zirconium, Fe—Mn—Cu-based materials, tungsten-based materials, or materials of transition metals and oxides thereof.

In a preferred implementation, the infrared emission coating 32 is preferably formed by an oxide or nitride of at least one metal element including Mg, Al, Ti, Zr, Mn, Fe, Co, Ni, Cu, and Cr, For example, the infrared emission coating 32 includes but not limited to the following materials: oxides ($Fe_2O_3$, $Al_2O_3$, $Cr_2O_3$, $In_2O_3$, $La_2O_3$, $Co_2O_3$, $Ni_2O_3$, $Sb_2O_3$, $Sb_2O_5$, $TiO_2$, $ZrO_2$, $MnO_2$, CuO, ZnO, MgO, CaO, $MoO_3$, etc.), carbides (for example, SiC), nitrides (for example, TiN, CrN, AlN, and $Si_3N_4$), or a combination of two or more of the above materials. When heated to an appropriate temperature, the materials radiate a far-infrared ray having a heating effect. The thickness can be preferably controlled from 30 μm to 50 μm. A manner of forming the infrared emission coating 32 on the surface of the base body 31 may be that the foregoing oxides of the metal element are sprayed on an outer surface of the base body 31 through atmospheric plasma spraying, and then are cured, to obtain the infrared emission coating 32.

In other variation implementations, the infrared emission coating 32 may further be formed on an inner surface of the base body 31.

The infrared emitter 30 further includes a first conductive coating 33 and a second conductive coating 34 respectively formed on at least a part of outer surfaces of opposite ends of the infrared emission coating 32. According to a preferred implementation shown in FIG. 4, the first conductive coating 33 and the second conductive coating 34 are both annular in shape and in contact with the infrared emission coating 32, and can be respectively electrically connected to a positive electrode and a negative electrode of a power source during use, so that the infrared emission coating 32 electrically generates heat and radiates the infrared ray. The first conductive coating 33 and the second conductive coating 34 may be conductive coatings formed by impregnation, coating, or the like, and may generally include silver, gold, palladium, platinum, copper, nickel, molybdenum, tungsten, niobium, or metal or alloy thereof.

Further, referring to FIG. 3, a heating mechanism further includes an insulator 40 located outside the infrared emitter 30 along a radial direction, where the insulator 40 is tubular in shape. The insulator 40 adopted in FIG. 3 is a vacuum insulator tube, specifically including two layers of tube walls from inside to outside along the radial direction, and a central region with a certain degree of vacuum in the center. The tube walls of the insulator 40 may be prepared by a rigid material such as stainless steel, ceramic, or PPEK, so as to reduce radial outward conduction of heat generated by the infrared emitter 30 during operation.

Further, referring to an embodiment shown in FIG. 3, the housing 10 is further provided with a tubular element 20 located along a length direction between the heating mechanism and in front of an air inlet hole 122, the tubular element 20 is configured to implement airflow communication between the cavity 310 and the air inlet hole 122 during inhalation. Referring to an arrow R in FIG. 3, during the inhalation, external air enters the housing 10 through the air inlet hole 122 and enters the cavity 310 through the interior hollow 21 of the tubular element 20, and then is inhaled by the user through the inhalable material A.

Further, referring to FIG. 3, in order to ensure a stable fixation of the infrared emitter 30 and the insulator 40 in the housing 10 and to provide support for the inhalable material A, the inhalable material A is fixedly maintained in the cavity 32. The housing 10 is further provided with an upper fixed seat 50 and a lower fixed seat 60 inside, and the upper fixed seat 50 and the lower fixed seat 60 are both substantially designed in a hollow annular shape. The upper fixed seat 50 and the lower fixed seat 60 respectively provide support to the infrared emitter 30 and the insulator 40 at the upper and lower ends, so that the infrared emitter 30 and the insulator 40 can be stably maintained in the housing 10.

Further, referring to FIG. 4, a conductive trajectory 35 for sensing the temperature of the infrared emitter 30 is formed on an outer surface of the infrared emitter 30 by printing or depositing. Specifically, the conductive trajectory 35 is prepared by a material with a positive or negative resistance-temperature coefficient, such as platinum, tungsten, iron-chromium-aluminum alloy, and the like. In this way, when the infrared emitter 30 generates heat and receives and accommodates heat transferred through the inhalable material A to produce a temperature change, the resistance of the conductive trajectory 35 has a positive or negative correlation with temperature, and thereby a resistance value of the conductive trajectory 35 can be detected by pins 351 at both ends of the conductive trajectory 35, and then the temperature of the infrared emitter 30 can be determined by the resistance value.

By using the foregoing infrared emitter 30 and by printing or depositing the conductive trajectory 35 capable of sensing the temperature of the infrared emitter 30 to make the infrared emitter 30 integrated with a temperature sensor function, the combination property is more stable and the result is more accurate compared with a case of using a temperature measurement manner of attaching thermocouples.

In the preferred implementation shown in FIG. 4, the conductive trajectory 35 is configured to be in a spiral shape that surrounds the infrared emitter 30 and extends along the axial direction of the infrared emitter 30. And, an extending length in the axial direction of the infrared emitter 30 fully covers the infrared emission coating 32, so that the conductive trajectory 35 can detect the temperature of more regions or parts of the infrared emitter 30.

In other optional implementations, the conductive trajectory 35 is a patterned conductive trajectory 35 formed in shape by stamping, printing, etching, electroplating, or the like. In other variation implementations, the patterned conductive trajectory 35 may be in a winding and bending shape extending along the axial direction of the infrared emitter 30.

Certainly, in the foregoing implementations, the conductive trajectory 35 and the infrared emission coating 32 on the surface of the infrared emitter 30 are insulated from each other to prevent interference in measuring the resistance of the conductive trajectory 35. Specifically, the implementations may be achieved by arranging an insulation layer (not shown in the figure) between the conductive trajectory 35 and the infrared emission coating 32. For example, a relatively thin insulating protective layer such as glass or glaze is deposited or sprayed on the surface of the infrared emission coating 32 during preparation, and then the conductive trajectory 35 is formed.

In another optional implementation, the conductive trajectory 35 is formed on an inner surface of the infrared emitter 30 surrounding the cavity 310, that is, the conductive trajectory 35 and the infrared emission coating 32 are respectively on two sides of the base body 31 along a radial direction of the base body 31. The conductive trajectory 35 is formed inside the infrared emitter 30.

Figure 5:
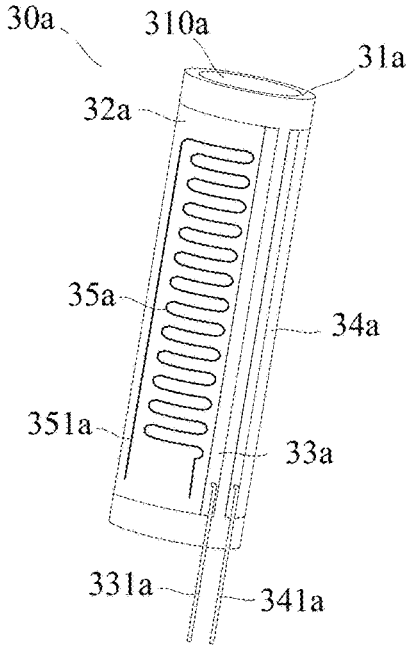
FIG. 5 is a schematic structural of another embodiment of the infrared emitter in FIG. 3.

In another optional embodiment shown in FIG. 5, the infrared emitter **30*a* includes a tubular base body 31*a*, and an electrothermal infrared emission film 32*a* wrapped or wound on an outer surface of the tubular base body 31*a*. The material of the electrothermal infrared emission film 32*a*** may be, for example, a zinc oxide film, a graphene film, or an indium oxide film doped with rare earth metals that can radiate an infrared ray at a certain temperature, or may be a composite film in which an infrared emission material is formed on a flexible film substrate such as polyimide, ceramic paper, or flexible glass. The thickness of the materials is usually about 30 to 500 nm.

A conductive trajectory 35*a* for sensing the temperature is formed on the surface of the infrared emission film 32*a* through printing or deposition. In the embodiment shown in FIG. 5, the conductive trajectory 35*a* is in a winding and bending shape extending along the axial direction of the infrared emitter 30*a*, and substantially covers the infrared emitter 30*a* for a relatively high length in the axial direction. Meanwhile, an electrical connection portion 351*a* is also printed on both ends of the conductive trajectory 35*a*. In an optional implementation, the electrical connection portion 351*a* is prepared by a material having a low resistance-temperature coefficient, such as copper, gold, silver, and the like.

In an optional implementation, the conductive trajectory 35/35*a* may have a thickness of about 10 to 30 microns.

Further, as shown in FIG. 5, in order to facilitate power supply to the infrared emission film 32*a*, a first conductive coating 33*a* and a second conductive coating 34*a* extending along the axial direction and used as electrodes are formed on both sides of the infrared emission film 23. The material may be a metal or alloy with low resistivity, such as silver, gold, palladium, platinum, copper, nickel, molybdenum, tungsten, niobium or the foregoing metal alloy material. In a specific implementation, a method of forming the first conductive coating 33*a* and the second conductive coating 34*a* on the surface of the infrared emission film 32*a* can be that a powder of the metal alloy material is mixed with an organic solvent or auxiliary agent to prepare a slurry, then the surface of the infrared emission film 32*a* is printed or coated through printing or coating, and then is cured, to obtain the first conductive coating 33*a* and the second conductive coating 34*a*. Certainly, in order to facilitate connection of the first conductive coating 33*a* and the second conductive coating 34*a* to the power source, the infrared emitter 30*a* further includes a first conductive pin 331*a* and a second conductive pin 341*a* formed through welding or the like.

Further, in the implementation shown in FIG. 5, the conductive trajectory 35*a* for detecting the temperature of the infrared emitter 30*a* is formed on the infrared emission film 32*a*. In preparation, the conductive trajectory 35*a* may be printed or deposited after the infrared emission film 32*a* is flattened, and then the infrared emission film 32*a* may be wrapped on a surface of the base body 31*a*.

Alternatively, in another variation implementation, the infrared emitter 30*a* is formed by printing or depositing the conductive trajectory 35*a* on the outer surface of the base body 31*a* and then winding or wrapping the infrared emission film 32*a*.

In other variation implementations, a plurality of infrared emission coatings 32 or infrared emission films 32*a* arranged side by side in sequence along the axial direction are formed on the infrared emitter 30/30*a*, the plurality of infrared emission coatings 32 or infrared emission films 32*a* can be independently controlled, so as to respectively heat different parts of the inhalable material A along the length direction.

Figure 6:
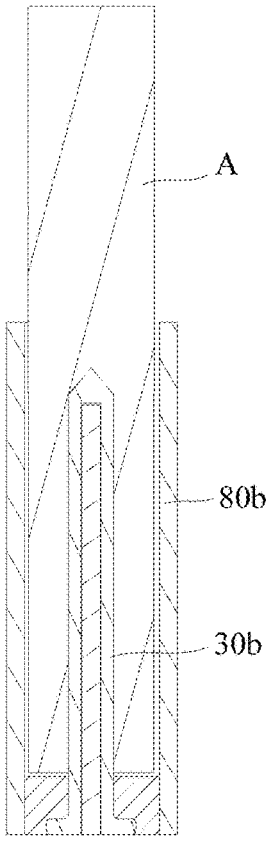
FIG. 6 is a schematic structural diagram of a vapor generation device according to another embodiment.

FIG. 6 shows a schematic diagram of a vapor generation device according to another variation embodiment of this application. The vapor generation device includes a tubular element 80*b*, and at least a part of the tubular element 80*b* is internally hollow and is configured as a cavity for receiving and heating an inhalable material A.

An infrared emitter 30*b* is in a pin shape extending along an axial center of the tubular element 80*b*, so that when the inhalable material A is received in the cavity, the infrared emitter 30*b* is inserted into the inhalable material A and emits the infrared ray for heating the inhalable material A.

Figure 7:
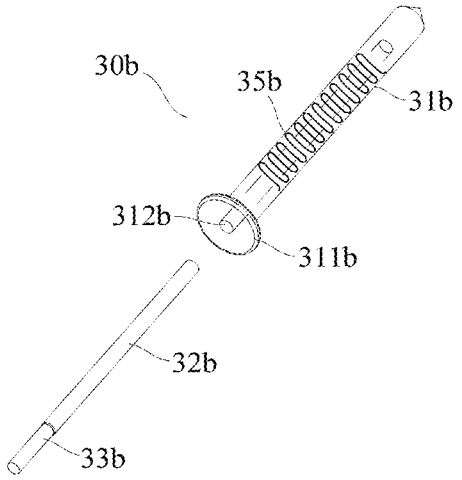
FIG. 7 is a schematic structural diagram of an embodiment of the infrared emitter in FIG. 6.

The specific configuration of the infrared emitter 30*b* may be shown in FIG. 7, including:

a base body 31*b*, prepared by a material that is rigid and can transmit an infrared ray, such as quartz, glass, or ceramic, and configured to be set into a pin shape for insertion into the inhalable material A.

Certainly, for ease of installation and fixation of the infrared emitter 30*b*, a base portion 311*b* is arranged on the base body 31*b*. The base body 31*b* is internally provided with a middle hole 312*b* extending along the axial direction.

An infrared emission coating 32*b* formed through spraying or the like outside an elongated rod-shaped substrate 33*b*, or an infrared emission film 32*b* wrapped or wound on the elongated rod-shaped substrate 33*b* may be encapsulated or accommodated in the base body 31*b* through the middle hole 312*b*, and may generate heat and radiate the infrared ray.

Based on temperature monitoring, a conductive trajectory 35*b* with a positive or negative resistance-temperature coefficient and for sensing the temperature of the infrared emitter 30*b* resistance-temperature coefficient is similarly formed on an outer surface of the base body 31*b* by printing, depositing, or the like.

Figure 8:
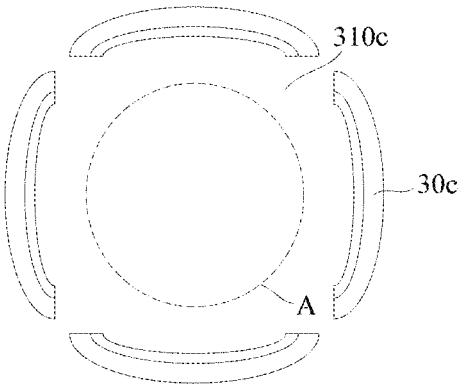
FIG. 8 is a schematic structural diagram of a vapor generation device according to another embodiment.

FIG. 8 shows a vapor generation device according to another embodiment. The vapor generation device includes a plurality of discrete infrared emitters 30*c*. The plurality of infrared emitters 30*c* may be in a flat sheet shape or may be an arcuate sheet shape as shown in FIG. 8, and are arranged around a cavity 320*c* receiving the inhalable material A. Each of the discrete infrared emitters 30*c* can be independently controlled and independently radiate the infrared ray to different regions of the inhalable material A, so as to respectively heat different regions of the inhalable material A received in the cavity 320*c*. Certainly, the conductive trajectory 35/35*a*/35*b* can be disposed on the infrared emitter 30*c* by printing, deposition, or the like, so as to monitor the temperature of the infrared emitter 30*c*.

Figure 9:
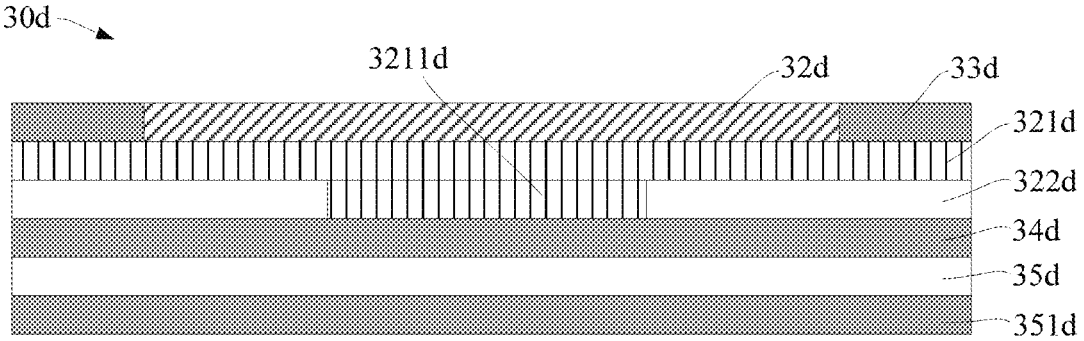
FIG. 9 is a schematic structural diagram of an infrared emitter according to another embodiment.

FIG. 9 is a schematic structural diagram of an infrared emitter 30*d* according to another embodiment. In this embodiment, the infrared emitter 30*d* may be a coating or a flexible film combined or wound on a quartz glass tube. Specifically, the infrared emitter 30*d* has a composite hierarchical structure formed by a plurality of functional layers, including the following layers:

An infrared emission layer 32*d*, which radiates an infrared ray after being heated in a manner of thermal infrared emission in this embodiment, and the material of which may be TiO2, ZrO2, or the like.

An electrothermal layer 321*d*, in which a resistor generates heat and transfers the heat to the infrared emission layer 32*d* and causes the infrared emission layer 32*d* to radiate the infrared ray at the time of power supply; and the material of which may be stainless steel, nickel-chromium alloy, iron-chromium-aluminum alloy, or the like, or may be a metal material whose resistivity increases rapidly the with temperature, such as Ni70Fe30 alloy, or the like.

Alternatively, in other variation implementations, the infrared emission layer 32*d* electrically emits the infrared ray, so that the infrared emitter 30*d* may not need the electrothermal layer 321*d*.

A first electrode layer 33*d* and a second electrode layer 34*d*, which are respectively formed on both sides of the electrothermal layer 321*d* to supply power for the electrothermal layer 321*d*. Highly conductive and oxidation-resistant materials, such as Ag, Ni, and the like are selected and used as the materials of the first electrode layer 33*d* and the second electrode layer 34*d*.

In design, the first electrode layer 33*d* is in the same layer as the infrared emission layer 32*d* and at least a part of the first electrode layer 33*d* surrounds the infrared emission layer 32*d*. A part 3211*d* of the electrothermal layer 321*d* toward the second electrode layer 34*d* protrudes, so as to come into contact with the second electrode layer 34*d*.

An insulation layer 322*d* is further disposed between the second electrode layer 34*d* and the electrothermal layer 321*d*, which is made of an insulating material, preferably a flexible insulating material, such as polyimide. In addition, the insulation layer 322*d* surrounds the protruding part 3211*d* of the electrothermal layer 321*d* toward the second electrode layer 34*d* in shape.

In the foregoing implementations, the insulation layer 322*d* is provided such that the second electrode layer 34*d* is electrically connected only to the protruding part 3211*d* of the electrothermal layer 321*d*; and the positions of the first electrode layer 33*d* distributed on both sides of the electrothermal layer 321*d* along a width direction shown in the figure are staggered from the position of the protruding part 3211*d*. In this way, when the electrothermal layer 321*d* is powered through the first electrode layer 33*d* and the second electrode layer 34*d*, the current can substantially completely flow through the entire electrothermal layer 321*d* to uniformly heat the entire electrothermal layer 321*d*.

Alternatively, in other variation implementations, the first electrode layer 33*d* is disposed close to a left end along the width direction of the electrothermal layer 321*d* in the figure, while the second electrode layer 34*d* is disposed close to a right end along the width direction of the electrothermal layer 321*d* in the figure. Certainly, the first electrode layer 33*d* and the second electrode layer 34*d* are respectively located on both sides of the electrothermal layer 321*d* along the thickness direction in the figure, so that the current can substantially completely flow through the entire electrothermal layer 321*d* along the width direction to uniformly heat the entire electrothermal layer 321*d*.

A thermistor layer 35*d*, which can receive heat transmitted by the electrothermal layer 321*d* through the second electrode layer 34*d* to cause a resistance change of the thermistor layer 35*d*, thereby facilitating the determination of the temperature of the electrothermal layer 321*d* through detection of a resistance value.

In a preferred implementation, the thermistor layer 35*d* is a ceramic PTC film, which can be made very thin by using a film technology (for example, PVD). In this way, a resistance value of the ceramic PTC can be very low (for example, less than 0.1 Ohm), thereby achieving a purpose of accurate temperature control. For some specific materials, the thermistor layer 35*d* is a material in which the resistivity increases suddenly, such as barium titanate ($BaTiO_3$), lead titanate ($PbTiO_3$), sodium bismuth titanate ($Bi_{0.5}Na_{0.5}TiO_3$), and the like.

A third electrode layer 351*d*, where the third electrode layer 351*d* and the second electrode layer 34*d* are respectively used as a positive end and a negative end of the thermistor layer 35*d* to detect a resistance of the thermistor layer 35*d*.

During use of the infrared emitter 30*d*, the first electrode layer 33*d*, the second electrode layer 34*d*, and the third electrode layer 351*d* can be separately soldered with a conductive pin or an electrical terminal, so as to facilitate a subsequent connection to a PCB board or a circuit board.

Figure 10:
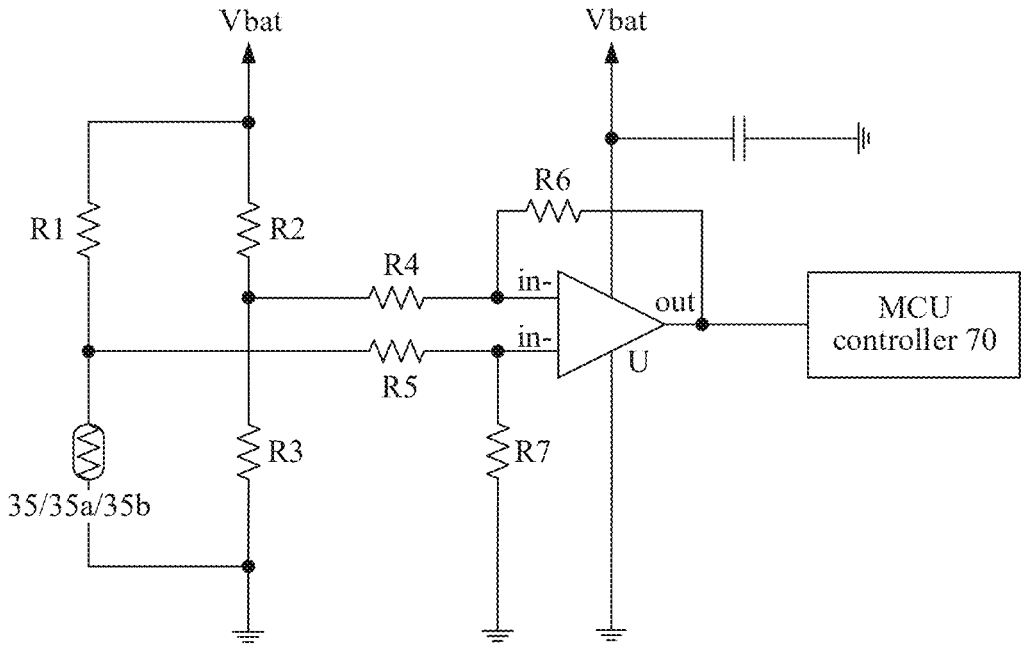
FIG. 10 is a schematic structural diagram of a part of circuit of a vapor generation device according to an embodiment.

Meanwhile, based on the temperature detection cooperating with the infrared emitter 30, a corresponding temperature detection circuit of the vapor generation device is shown in FIG. 10, including:

a voltage divider resistor R1, which is a standard resistor having a standard resistance value, and forms a voltage divider circuit with the conductive trajectory 35/35*a*/35*b* or the thermistor layer 35*d* to calculate a resistance of the conductive trajectory 35/35*a*/35*b* or the thermistor layer 35*d*; and a trans-operational amplifier U, in which a signal input end in+ acquires voltages at both ends of the conductive trajectory 35/35*a*/35*b* or the thermistor layer 35*d*, a reference signal input end in-inputs a reference voltage, and an output end out outputs a result signal of the temperature correlated with the resistance of the conductive trajectory 35/35*a*/35*b* or the thermistor layer 35*d* to an MCU controller 70; and resistors R2 to R7, performing regular voltage division and current limitation on each current path, so that each electronic element can obtain a required specific working voltage and normal working current, to ensure a normal working state.

Then, the MCU controller 70 controls the power of the infrared emitter 30 according to the result and keeps the temperature of the inhalable material A consistent with a preset target temperature.

It should be noted that, the specification of this application and the accompanying drawings thereof illustrate preferred embodiments of this application, but this application is not limited to the embodiments described in the specification. Further, a person of ordinary skill in the art may make improvements or variations according to the foregoing descriptions, and such improvements and variations shall all fall within the protection scope of the appended claims of this application.

What is claimed is:

1. A vapor generation device, configured to heat an inhalable material to generate an aerosol for inhalation, comprising: a housing, wherein the housing is internally provided with:

a cavity, configured to receive an inhalable material;

an infrared emitter, comprising an infrared emission material, wherein the infrared emission material is configured to radiate an infrared ray to the inhalable material received in the cavity, so as to heat the inhalable material;

a temperature sensing material, formed on the infrared emitter and insulated from the infrared emission material, wherein the temperature sensing material has a positive or negative resistance-temperature coefficient; and a circuit, configured to obtain a resistance value of the temperature sensing material and determine a temperature of the infrared emitter from the resistance value.

2. The vapor generation device according to claim 1, wherein the temperature sensing material comprises a conductive trajectory or a thermistor coating formed on the infrared emitter.

3. The vapor generation device according to claim 2, wherein the conductive trajectory is configured in a winding, bending, or spiral shape extending along a length direction of the infrared emitter.

4. The vapor generation device according to claim 2, wherein the infrared emitter comprises:

an electrothermal layer, comprising a first side and a second side facing away from each other along a thickness direction;

the infrared emission material is positioned on the first side of the electrothermal layer and configured to radiate an infrared ray to the inhalable material received by the cavity when heated by the electrothermal layer; and the thermistor coating is positioned on the second side of the electrothermal layer.

5. The vapor generation device according to claim 4, wherein the infrared emitter further comprises:

a first electrode layer, positioned on a first side of the electrothermal layer and electrically conductive with the electrothermal layer;

a second electrode layer, positioned between the electrothermal layer and the thermistor coating and electrically conductive with both the electrothermal layer and the thermistor coating; and a third electrode layer, positioned on a side of the thermistor coating away from the electrothermal layer and electrically conductive with the thermistor coating.

6. The vapor generation device according to claim 5, wherein the first electrode layer and the second electrode layer are staggered from each other along a thickness direction of the electrothermal layer.

7. An infrared emitter for a vapor generation device, comprising:

an infrared emission material, configured to radiate an infrared ray to an inhalable material to heat the inhalable material; and a temperature sensing material, insulated from the infrared emission material and having a positive or negative resistance-temperature coefficient, so that a temperature of the infrared emitter is capable of being determined from a resistance value of the conductive trajectory or thermistor coating by measuring the resistance value.

8. The vapor generation device according to claim 2, wherein the infrared emitter is configured to extend along an axial direction of the cavity and surround at least a part of the cavity.

9. The vapor generation device according to claim 8, wherein the infrared emitter further comprises:

a base body, extending along the axial direction of the cavity and surrounding the cavity; and the infrared emission material is arranged to be a coating formed on the base body or a film wrapped or wound on the tubular base body.

10. The vapor generation device according to claim 9, wherein at least a part of a length of the temperature sensing material extending along the axial direction of the cavity covers a length of the infrared emission material extending along the axial direction of the cavity.

11. The vapor generation device according to claim 2, wherein the infrared emitter is configured in a shape of pin extending along an axial direction of the cavity, and is inserted into the inhalable material when the inhalable material is received in the cavity.

12. The vapor generation device according to claim 11, wherein the infrared emitter comprises:

a base body, configured to be in a pin shape at least a part of which extends along the axial direction of the cavity, wherein the base body is provided with a hollow extending along the axial direction inside; and a substrate, accommodated in the hollow; and the infrared emission material is arranged to be a coating formed on a surface of the substrate or a film wrapped on the substrate.

13. The vapor generation device according to claim 12, wherein the temperature sensing material is formed on a surface of the base body.

14. The vapor generation device according to claim 1, wherein the infrared emitter is configured to extend along an axial direction of the cavity and surround at least a part of the cavity.

15. The vapor generation device according to claim 14, wherein the infrared emitter further comprises:

a base body, extending along the axial direction of the cavity and surrounding the cavity; and the infrared emission material is arranged to be a coating formed on the base body or a film wrapped or wound on the tubular base body.

16. The vapor generation device according to claim 15, wherein at least a part of a length of the temperature sensing material extending along the axial direction of the cavity covers a length of the infrared emission material extending along the axial direction of the cavity.

17. The vapor generation device according to claim 1, wherein the infrared emitter is configured in a shape of pin extending along an axial direction of the cavity, and is inserted into the inhalable material when the inhalable material is received in the cavity.

18. The vapor generation device according to claim 17, wherein the infrared emitter comprises:

a base body, configured to be in a pin shape at least a part of which extends along the axial direction of the cavity, wherein the base body is provided with a hollow extending along the axial direction inside; and a substrate, accommodated in the hollow; and the infrared emission material is arranged to be a coating formed on a surface of the substrate or a film wrapped on the substrate.

19. The vapor generation device according to claim 7, wherein the temperature sensing material is formed on a surface of the base body.

* * * * *